US008875874B2

(12) United States Patent
Helou, Jr.

(10) Patent No.: US 8,875,874 B2
(45) Date of Patent: Nov. 4, 2014

(54) MULTI-COMPARTMENT MIXING CONTAINER AND METHOD OF FILLING

(75) Inventor: Elie Helou, Jr., Carpinteria, CA (US)

(73) Assignee: Biosphere Spirits, LLC, Carpinteria, CA (US)

( * ) Notice: Subject to any disclaimer, the term of this patent is extended or adjusted under 35 U.S.C. 154(b) by 149 days.

(21) Appl. No.: 13/069,673

(22) Filed: Mar. 23, 2011

(65) Prior Publication Data

US 2011/0192734 A1 Aug. 11, 2011

Related U.S. Application Data

(63) Continuation-in-part of application No. 11/836,699, filed on Aug. 9, 2007, now Pat. No. 8,104,611.

(51) Int. Cl.
*B65D 81/32* (2006.01)
*B65B 31/00* (2006.01)

(52) U.S. Cl.
CPC ..... *B65D 81/3222* (2013.01); *B65B 2230/02* (2013.01); *B65B 31/00* (2013.01)
USPC ..... 206/219; 206/221; 215/6

(58) Field of Classification Search
USPC ..... 206/219, 221, 220, 568, 804; 215/DIG. 8, 6
See application file for complete search history.

(56) References Cited

U.S. PATENT DOCUMENTS 933,444 A 9/1909 Henke, Jr. ..... 220/506
937,049 A 10/1909 Callahan
1,706,335 A 3/1929 Toch ..... 220/506
2,385,648 A * 9/1945 Prager ..... 206/221
2,661,870 A 12/1953 Huenergardt ..... 222/129
2,661,871 A 12/1953 Huenergardt ..... 222/129
2,884,149 A 4/1959 Zimmermann et al. ..... 215/231
2,923,247 A 2/1960 Boyer
2,981,435 A * 4/1961 McCarthy ..... 220/522
3,076,573 A 2/1963 Thomas
3,169,654 A 2/1965 Pollklesener ..... 215/231
3,275,180 A 9/1966 Optner et al. ..... 206/521

(Continued)

FOREIGN PATENT DOCUMENTS

EP 0 060 401 9/1982

OTHER PUBLICATIONS

European Search Report, dated Nov. 18, 2008 for EP Application No. 08161164.2.

(Continued)

*Primary Examiner* — Steven A. Reynolds
(74) *Attorney, Agent, or Firm* — Sheppard, Mullin, Richter & Hampton LLP

(57) ABSTRACT

A mixing container including an outer vessel, one or more inner vessels, and a lid. The outer vessel has a bottom, an open mouth and a peripheral sidewall between the open mouth and the bottom. The one or more inner vessels each have an end, an open mouth and a peripheral sidewall between the end and the open mouth. The lid is configured to be removably coupled to the open mouth of the outer vessel and the lid is characterized as having an outer surface and an inner surface coupled to the ends of the one or more inner vessels. A seal is formed between the open mouth of each one of the one or more inner vessels and the bottom of the outer vessel when the lid is coupled to the open mouth of the outer vessel.

5 Claims, 16 Drawing Sheets

(56) References Cited

U.S. PATENT DOCUMENTS

| | | | | | |
|---|---|---|---|---|---|
| 3,458,076 | A | * | 7/1969 | Babcock | 215/6 |
| 3,459,295 | A | | 8/1969 | Cousar | 215/6 |
| 3,613,955 | A | | 10/1971 | Wetherell, Jr. | |
| 3,696,919 | A | | 10/1972 | Miles | 215/6 |
| 3,705,661 | A | | 12/1972 | Davis | |
| 3,741,383 | A | * | 6/1973 | Wittwer | 206/219 |
| 3,743,520 | A | | 7/1973 | Croner | |
| 3,819,081 | A | | 6/1974 | Runte | 220/23.87 |
| 3,856,138 | A | | 12/1974 | Maekawa et al. | 206/221 |
| 4,215,786 | A | | 8/1980 | Vertes | 215/231 |
| 4,279,349 | A | | 7/1981 | Aigner | |
| 4,410,085 | A | | 10/1983 | Beneziat et al. | |
| 4,585,150 | A | | 4/1986 | Beacham et al. | 222/129 |
| 4,762,224 | A | | 8/1988 | Hall | 206/221 |
| 4,765,514 | A | | 8/1988 | Berglund | 222/145 |
| 4,805,789 | A | | 2/1989 | Lancesseur et al. | 215/6 |
| 4,808,006 | A | | 2/1989 | Kauffler | |
| 4,854,182 | A | * | 8/1989 | Ryan et al. | 73/864.64 |
| 4,915,255 | A | | 4/1990 | Curtis | 220/23.89 |
| 4,950,237 | A | | 8/1990 | Henault et al. | |
| 4,979,402 | A | * | 12/1990 | Ryan et al. | 73/863 |
| 4,993,595 | A | | 2/1991 | Bertram et al. | 222/129 |
| 5,060,791 | A | | 10/1991 | Zulauf | |
| 5,114,411 | A | | 5/1992 | Haber et al. | 604/203 |
| 5,215,214 | A | | 6/1993 | Lev et al. | |
| 5,217,145 | A | | 6/1993 | Haan et al. | |
| 5,316,146 | A | | 5/1994 | Graff | 206/438 |
| 5,352,196 | A | | 10/1994 | Haber et al. | 604/90 |
| 5,356,040 | A | | 10/1994 | Reggiani | |
| 5,398,827 | A | | 3/1995 | Armstrong et al. | |
| 5,447,226 | A | | 9/1995 | Laine | |
| 5,499,738 | A | | 3/1996 | Burleigh | |
| 5,769,680 | A | | 6/1998 | Hoffman | 446/75 |
| 5,811,060 | A | * | 9/1998 | Laguna Valderrama | 422/556 |
| 6,003,718 | A | * | 12/1999 | Lu | 220/592.2 |
| 6,059,443 | A | | 5/2000 | Casey | |
| 6,085,927 | A | * | 7/2000 | Kusz | 220/23.87 |
| 6,464,078 | B1 | | 10/2002 | Grossnickle | 206/459.5 |
| 6,550,647 | B1 | | 4/2003 | Künz | |
| 6,619,494 | B1 | | 9/2003 | Brozell et al. | 215/231 |
| 6,641,854 | B2 | * | 11/2003 | Gerhart et al. | 426/394 |
| 6,905,038 | B2 | | 6/2005 | Lopez | |
| 7,325,676 | B2 | * | 2/2008 | Galaz Rodriguez | 206/219 |
| 7,413,083 | B2 | * | 8/2008 | Belfance et al. | 206/540 |
| 8,083,056 | B1 | * | 12/2011 | Wu | 206/221 |
| 2004/0188281 | A1 | | 9/2004 | Iwasa et al. | 206/219 |
| 2006/0163252 | A1 | * | 7/2006 | Zalewski | 220/254.3 |
| 2007/0017831 | A1 | | 1/2007 | Kindt | 206/219 |
| 2009/0211927 | A1 | | 8/2009 | Wu | 206/219 |
| 2009/0294397 | A1 | * | 12/2009 | Wu | 215/6 |
| 2010/0018880 | A1 | | 1/2010 | Helou | |
| 2010/0133294 | A1 | | 6/2010 | Chan et al. | |
| 2012/0168441 | A1 | | 7/2012 | Lane | |

OTHER PUBLICATIONS

PCT International Preliminary Report on Patentability dated Mar. 18, 2014 with Written Opinion of the International Searching Authority dated May 31, 2012, for International Application No. PCT/US2012/030423.

PCT International Search Report dated Mar. 6, 2014 with Written Opinion of the International Searching Authority dated Feb. 17, 2014, for International Application No. PCT/US2013/062712.

* cited by examiner

MULTI-COMPARTMENT MIXING CONTAINER AND METHOD OF FILLING

CROSS-REFERENCE TO RELATED APPLICATIONS

This application is a continuation-in-part of U.S. patent application Ser. No. 11/836,699, filed Aug. 9, 2007, now U.S. Pat. No. 8,104,611, issued on Jan. 31, 2012, the contents of which are incorporated herein by reference in its entirety.

FIELD OF THE INVENTION

The present invention relates to mixing containers and, more particularly, to multi-compartment mixing containers.

BACKGROUND

There are a number of useful compositions which are comprised of two or more components, such as mixed beverages, nutritional supplements, and industrial chemicals. Certain types of compositions, however, suffer from change or degradation within a relatively short time after combining the components comprising the composition. This is often due to the reactivity of the components and/or long-term storage of these types of compositions is not practical. Moreover, certain combinations oxidize or change color over time or when mixed; therefore, it is not desired to separate components of these combinations until just prior to use.

Consumers are more likely to purchase ready-to-use products over those that require preparation. For example, a beverage that requires a consumer to measure and mix multiple components together is more burdensome and less attractive than a beverage that may simply be opened and consumed.

Dual mixing containers which automatically mix liquids upon opening generally tend to require a complicated design. Where beverages and other price sensitive products are to be mixed, inexpensive and uncomplicated mechanisms are needed to facilitate manufacturing, filling operations and eventual use by the consumers.

SUMMARY

In one embodiment, a multi-compartment mixing container is provided. The mixing container comprising an outer vessel, one or more inner vessels, and a lid. The outer vessel comprises a bottom, an open mouth and a peripheral sidewall between the open mouth and the bottom. The one or more inner vessels each have an end, an open mouth and a peripheral sidewall between the end and the open mouth. The lid is configured to be removably coupled to the open mouth of the outer vessel and the lid comprises an outer surface and an inner surface coupled to the ends of the one or more inner vessels. A seal is formed between the open mouth of each one of the one or more inner vessels and the bottom of the outer vessel when the lid is coupled to the open mouth of the outer vessel.

In another embodiment, a method for manufacturing a mixing container comprising two or more components is provided. The mixing container comprises an outer vessel, one or more inner vessels disposed within the outer vessel, a lid to enclose the outer vessel and the one or more inner vessels disposed therein, and a first set of one or more fill holes corresponding to the outer vessel and a second set of one or more fill holes corresponding to each one of the one or more inner vessels. The method comprises filling the outer vessel with a first component through the first set of one or more fill holes; filling the one or more inner vessels with one or more components through the second set of one or more fill holes, wherein the one or more components are different from each other and from the first component; and covering the first and second set of one or more fill holes.

In a further embodiment, a method for manufacturing a mixing container comprising two or more components is disclosed. The mixing container comprises an outer vessel comprising a bottom and an open mouth, one or more inner vessels disposed within the outer vessel and comprising an end and an open mouth, a lid comprising an outer surface and a coupling surface, the lid configured to enclose the outer vessel and the one or more inner vessels disposed therein, and one or more fill holes corresponding to the outer vessel. The method comprises coupling the one or more inner vessels to the coupling surface of the lid; filling each one of the one or more inner vessels with one or more components through the open mouths of the one or more inner vessels; placing the outer vessel over the filled one or more inner vessels such that the open mouths of the one or more inner vessels contacts and forms a seal with the bottom of the outer vessel and the lid couples with the open mouth of the outer vessel; filling the outer vessel with an outer component through the one or more fill holes; and covering the one or more fill holes with a cover.

Other objects, features and advantages of the present invention will become apparent to those skilled in the art from the following detailed description.

BRIEF DESCRIPTION OF THE DRAWINGS

Illustrative embodiments of the present invention are described herein with reference to the accompanying drawings, in which.

Like numerals refer to like parts throughout the several views of the drawings.

DETAILED DESCRIPTION OF THE PREFERRED EMBODIMENTS

The multi-compartment mixing containers described herein provide a practical and cost-effective design for separately storing a plurality of components, such as liquids, powders, or pellets, within a single outer container and for mixing the components by simply removing the outer container lid. Methods for assembling the multi-compartment containers and for filling a multi-compartment container comprising a plurality of different components is further described herein.

Figure 1A:
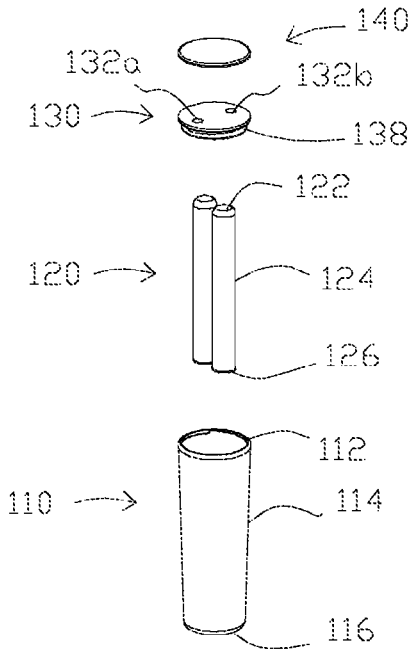
FIG. 1A is an exploded perspective view of a multi-compartment mixing container in which the two inner vessels each have a closed end and an open end.
Figure 1B:
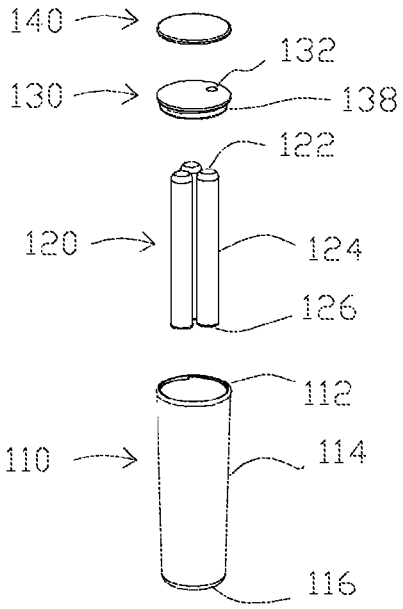
FIG. 1B is an exploded perspective view of a multi-compartment mixing container in which the three inner vessels each have a closed end and an open end.

FIGS. 1A-B depict an embodiment of a multi-compartment mixing container. In accordance with this embodiment, the mixing container comprises an outer container 110, a plurality of inner containers 120, a lid 130 and a cover 140.

The outer container 110 comprises an open mouth 112, a bottom 116, and a sidewall 114 between the open mouth 112 and closed bottom 116.

The plurality of inner containers 120 is preferably configured and dimensioned to fit within dimensions of the outer container 110 and each comprise a closed end 122, an open mouth 126 and a side wall 124 disposed between the closed end 122 and open mouth 126.

The lid 130 is configured to be coupled to the open mouth 112 of the outer container 110 by any means known to one of ordinary skill in the art. In accordance with one embodiment, full or half threads may be provided about the open mouth 112 of the outer container 110 along the inner periphery, the outer periphery, or both. The full or half threads are configured to mate with corresponding threads 138 provided along the periphery of the lid 130.

In accordance with another embodiment, the lid 130 may be coupled to the open mouth 112 of the outer container 110 via friction fit. For example, at least a portion of the lid 130 may be sized to fit within the open mouth 112 of the outer container 110 in a manner similar to a cork and bottle. The friction fit may also be accomplished by fitting an elastomeric o-ring around the portion of the lid 130 fitting within the open mouth 112 of the outer container 110. Alternatively, an elastomeric coating may be provided on the sidewall of the lid 130 to effectuate a snug fit between the lid 130 and the interior side wall of the open mouth 112 of the outer container 110. One or more combination of the above may also be used.

The lid 130 may further comprise at least one fill hole 132*a* and at least one vent hole 132*b*. Alternatively, the lid 130 may comprise only a single hole which may be used both as a fill hole and a vent hole. As shown in the embodiment depicted in FIGS. 1A-B, the at least one fill hole 132*a* and the at least one vent hole 132*b* are in fluid communication with interior cavity of the outer container 110 and thus provides a means for filling the outer container 110 with liquids, powders, mixtures, and the like when the lid 130 is secured to the open mouth 112 of the outer container 110.

The closed end 122 of each one of the plurality of inner container 120 is coupled to the lid 130 such that the open end 126 of the inner container 120 is arranged in facing relation to the bottom 116 of the outer container 110 when the lid 130 is coupled to the open end 112 of the outer container 110. Because the outer container open end 112 and the inner container open ends 126 face in opposing directions, the inner containers 120 must be filled before they are secured within the outer container 110, as further described in relation to FIGS. 8A-E. Moreover, while FIGS. 1A-B depict the lid 130 and inner containers 120 as being separate pieces, it is understood that they may be constructed as an integral piece.

As shown in FIG. 1A, a fill hole 132*a* may be provided for filling the outer container 110 and a vent hole 132*b* may optionally be provided for the release of air or gases during the filling process. Alternatively, a single fill hole 132 may be provided (see FIG. 1B) and may preferably be sized so as to allow for both the filling operation and the release of air or gas from the outer container. Again, the filing operation for the container is further described in relation to FIGS. 8A-E.

A cover 140 may be provided to cover the fill/vent holes 132*a, b* after the filing of the outer container 130 is completed. The cover 140 may be secured to the lid 130 by means of an adhesive, snap fit, mating threads, friction fit or other means known to one of skill in the art. Alternatively, the air remaining in the headspace of the filled outer container 110 may be at least partially, if not completely, evacuated to create at least a partial vacuum before the cover 140 is affixed to the lid 130. The at least partial vacuum is preferably sufficient to help secure the cover 140 and lid 130 securely attached to each other and to the outer container 110. A plastic shrink wrap or other means that may be used as a tamper evident feature may be provided to further secure the cover 140, lid 130 and outer container 110 together.

Figure 2A:
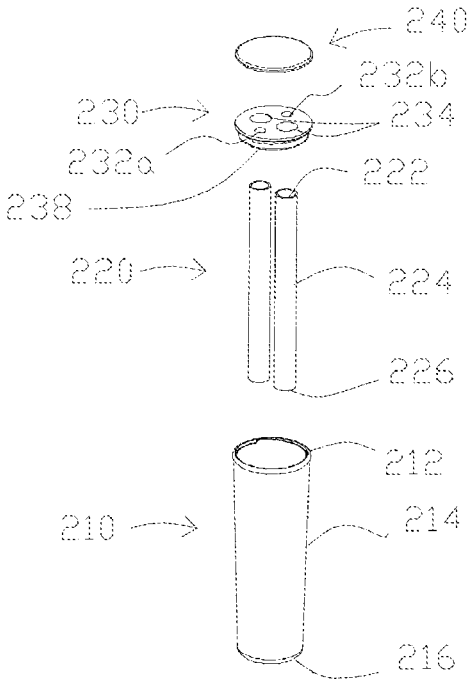
FIG. 2A is an exploded perspective view of a multi-compartment mixing container in which the two inner vessels each have two open ends.
Figure 2B:
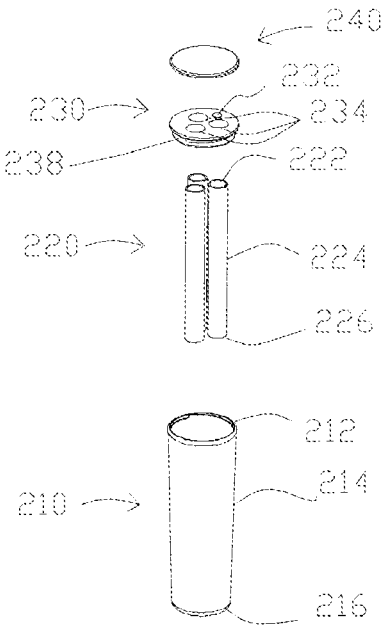
FIG. 2B is an exploded perspective view of a multi-compartment mixing container in which the three inner vessels each have two open ends.
Figure 2C:
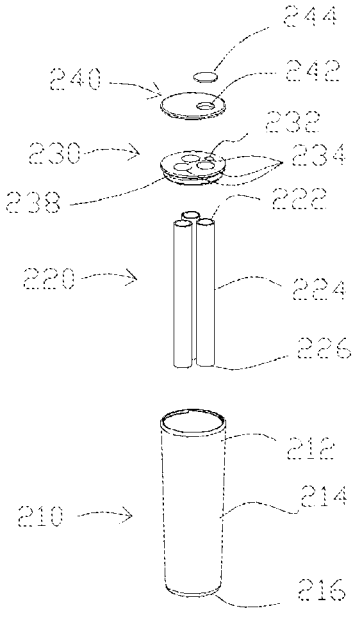
FIG. 2C is an exploded perspective view of the multi-compartment mixing container of FIG. 2B in which the cover comprises a reclosable opening to permit access to one of the inner containers after final assembly of the multi-compartment mixing container.

FIGS. 2A-C depict another embodiment of a multi-compartment mixing container. While the embodiment depicted in FIGS. 2A-C is similar, in many respects, to the multi-compartment mixing container depicted in FIGS. 1A-B, the embodiment depicted in FIGS. 2A-C incorporates inner containers 220 comprising two open ends 222, 226, whereas the embodiment in FIGS. 1A-B incorporates inner containers 120 comprising only one open end 126.

In accordance with the embodiment depicted in FIGS. 2A-C, the mixing container comprises an outer container 210, a plurality of inner containers 220, a lid 230 and a cover 240.

The outer container 210 comprises an open mouth 212, a bottom 216, and a sidewall 214 between the open mouth 212 and closed bottom 216.

The plurality of inner containers 220 is preferably configured and dimensioned to fit within dimensions of the outer container 210 and the inner containers 220 each comprise a open end 222, an open mouth 226 and a side wall 224 disposed between the open end 222 and the open mouth 226.

The lid 230 is configured to be coupled to the open mouth 212 of the outer container 210, preferably by mating of the full- or half-threads surrounding the interior surface of the open mouth 212 of the outer container 210 with the corresponding full or half-threads 238 surrounding the lid 230. In accordance with this embodiment, the full- or half-threads 238 surrounding the lid 230 is contained within the open mouth 212 of the outer container 210 when the lid is affixed thereto. Alternatively, the open mouth 212 of the outer container may additionally have full or partial threads along the exterior surface to engage a corresponding set of full or partial threads on the lid 230. In the embodiment depicted in FIGS. 2A-C, the lid 230 is configured to be coupled to the open mouth 212 of the outer container 210 in the same manner as described in relation to FIGS. 1A-B. The lid 230 may further comprise two sets of fill holes 232, 234 which correspond to the inner cavities of the outer container 210 and inner containers 220, respectively, when the lid 230 is coupled to the open mouth 212 of the outer container 210.

In contrast to the embodiment depicted in FIGS. 1A-B, the two sets of fill holes 233, 234 disposed on the lid 230 provide means for filling both the outer container 210 and inner containers 220 with liquids, powders and other components after the lid 230 is secured to the open mouth 212 of the outer container 210, as further described in relation to FIGS. 9A-D. Moreover, while FIGS. 2A-B depict the lid 230 and inner containers 220 as being separate pieces, it is understood that they may be constructed as an integral piece. At least one fill hole 232*a* and optionally at least one vent hole 232*b* may be provided for filling the outer container 210, as depicted in FIG. 1A. Alternatively, only one fill hole 232 may be provided so long as it is of a sufficient dimension to allow for the venting of gases during the filling operations.

The cover 240 may be provided to cover the fill holes 232, 234 after the filing of the outer and inner containers 210 is completed. The cover 240 may be secured to the outer surface of the lid 230 by means of an adhesive. Alternatively, a vacuum may be applied in the outer and inner containers 210, 220 before applying the cover 240 to maintain the cover 240 and lid 230 securely attached to each other and to the outer container 210. Alternatively, mating threads or other features may also be used to secure the cover 240 to the lid 230. Again, the cover 240 may be secured onto the lid 230 in a manner similar to that described in relation to FIG. 1A-B.

A tamper-resistant or tamper-evident mechanism may optionally be provided as an added measure of security. The tamper-resistant mechanism may include plastic shrink wrap or other covering coupling the lid 230 to the outer container 210. FIG. 9D further depicts a tamper-resistant mechanism 950 that may be used to secure the cover 940 and lid 930 to the outer container 910. The tamper-resistant mechanism may be made of a variety of materials, such as metal, plastic, paper, or wax so long as it provides an indication as to the integrity of the lid 230 and the outer container 210 (i.e., that the lid 230 has not previously been opened or removed from the outer container 210 and then replaced).

FIG. 2C depicts yet another embodiment in which access to one or more of the inner tubes 220 is provided by means of an opening 242 of the cover 240 after final assembly of the outer container 210, inner containers 220, lid 230 and cover 230. The opening 242 may be closed with a cover lid 244 or other means or left off completely. Either one or both of the cover 240 and cover lid 244 may be reusable or may be configured for a single use, such as by a tear-off or peel-off lid.

The embodiment depicted in FIG. 2C is especially desirable where additional components are to be introduced after final assembly of the multi-compartment mixing container. For example, where the multi-compartment mixing container is used to package mixed drinks, wherein the components for mixing are separately stored in the respective outer and inner containers 210, 220, the inner containers positioned corresponding to the opening 242 may be provided to allow for the addition of other components, such as ice, after final assembly of the container and the components contained therein and prior to removing the cover. Again, the cover lid 244 may be coupled to the cover opening 242 in the same manner as described with respect to the cover 240 and the lid 230.

Figure 3:
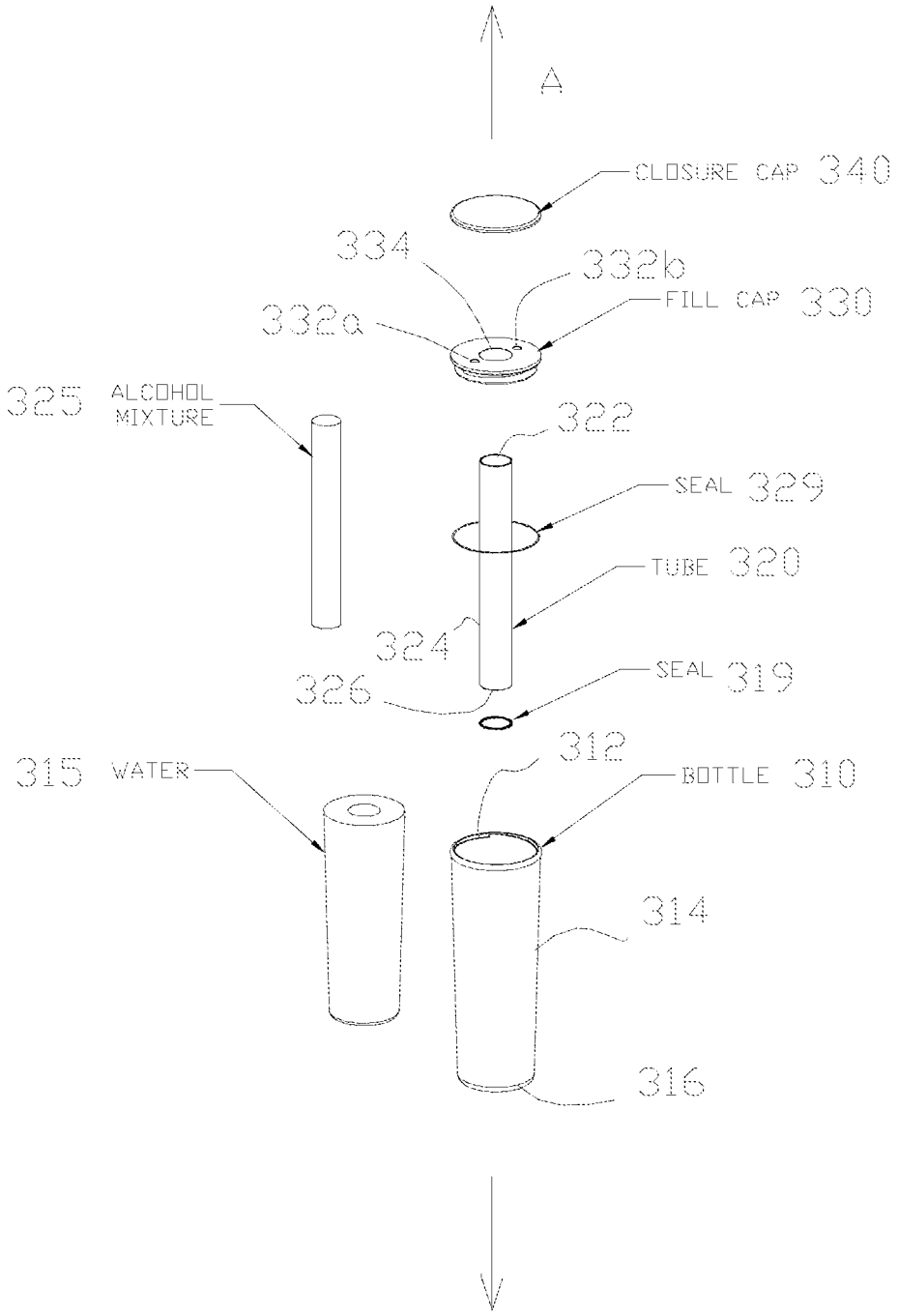
FIG. 3 is an exploded perspective view of a multi-compartment mixing container having one inner vessel.

FIG. 3 depicts a further embodiment of a multi-compartment mixing container having only one inner container that may be used in connection with a two-component beverage. In accordance with this embodiment, the mixing container comprises an outer container 310, an inner container 320, a fill cap 330 and a closure cap 340. This embodiment may be used where it is desirable to separately store only two components (e.g., alcohol or alcohol mixture 325 in the inner container 320 and water 315 in the outer container 310, or vice versa, depending on the nature and relative quantities required for the final beverage) for later mixing within the outer container 310.

The outer container 310 is constructed in a manner similar to that described with respect to FIGS. 1A-B and 2A-B above. The inner container 320 shown in FIG. 3 is preferably a tubular structure but may be other shapes such as square, rectangular, triangular, or oval, having two open ends 322, 326 and a peripheral sidewall 324 there between. The top open end 322 of the inner container 320 is securely coupled to the underside of the fill cap 330 and corresponds to a fill hole 334 centrally disposed thereon. The fill cap 330 further comprises at least one fill hole 332*a* and optionally at least one vent hole 332*b*, each in fluid communication with the outer container 310. A closure cap 340 is provided to seal the contents of the inner container 320 and outer container 310 from leaking.

Figure 11:
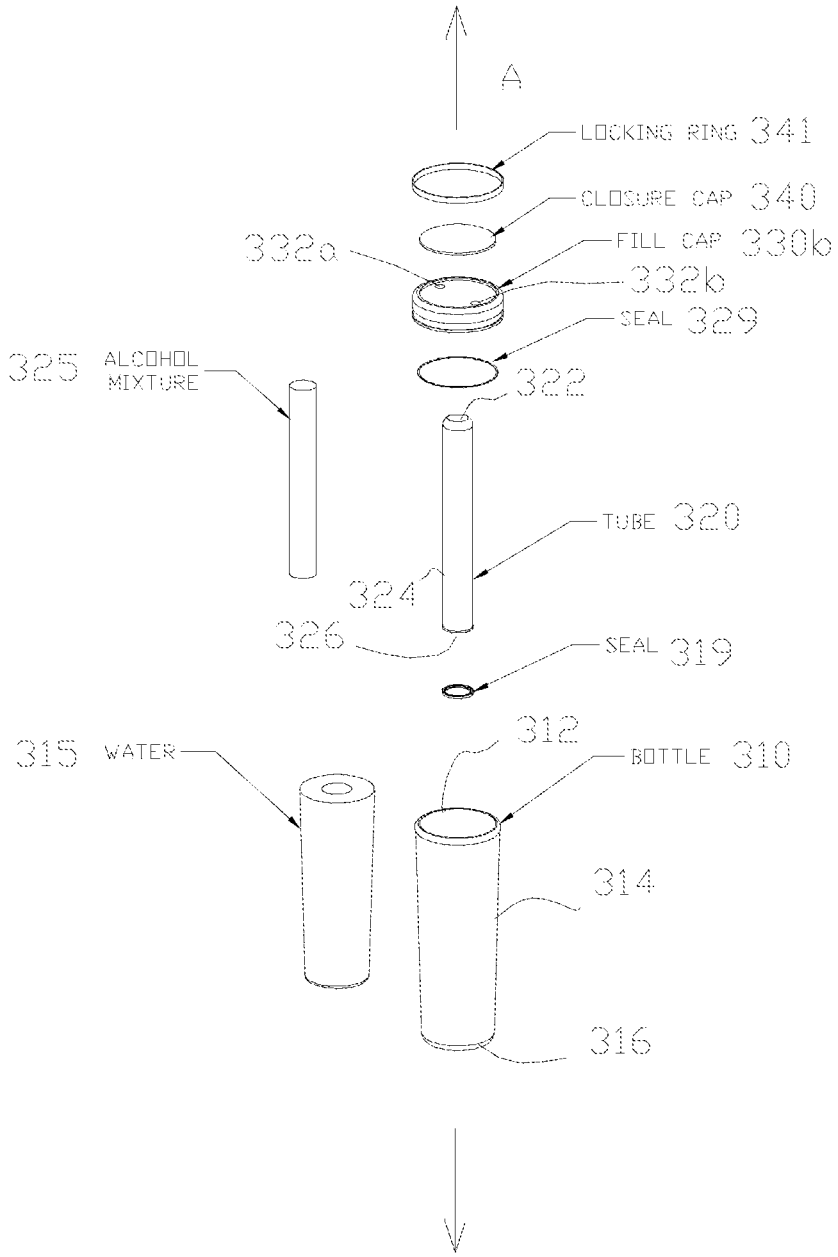
FIG. 11 is an exploded perspective view of another embodiment of the multi-compartment mixing container of FIG. 3.
Figure 12:
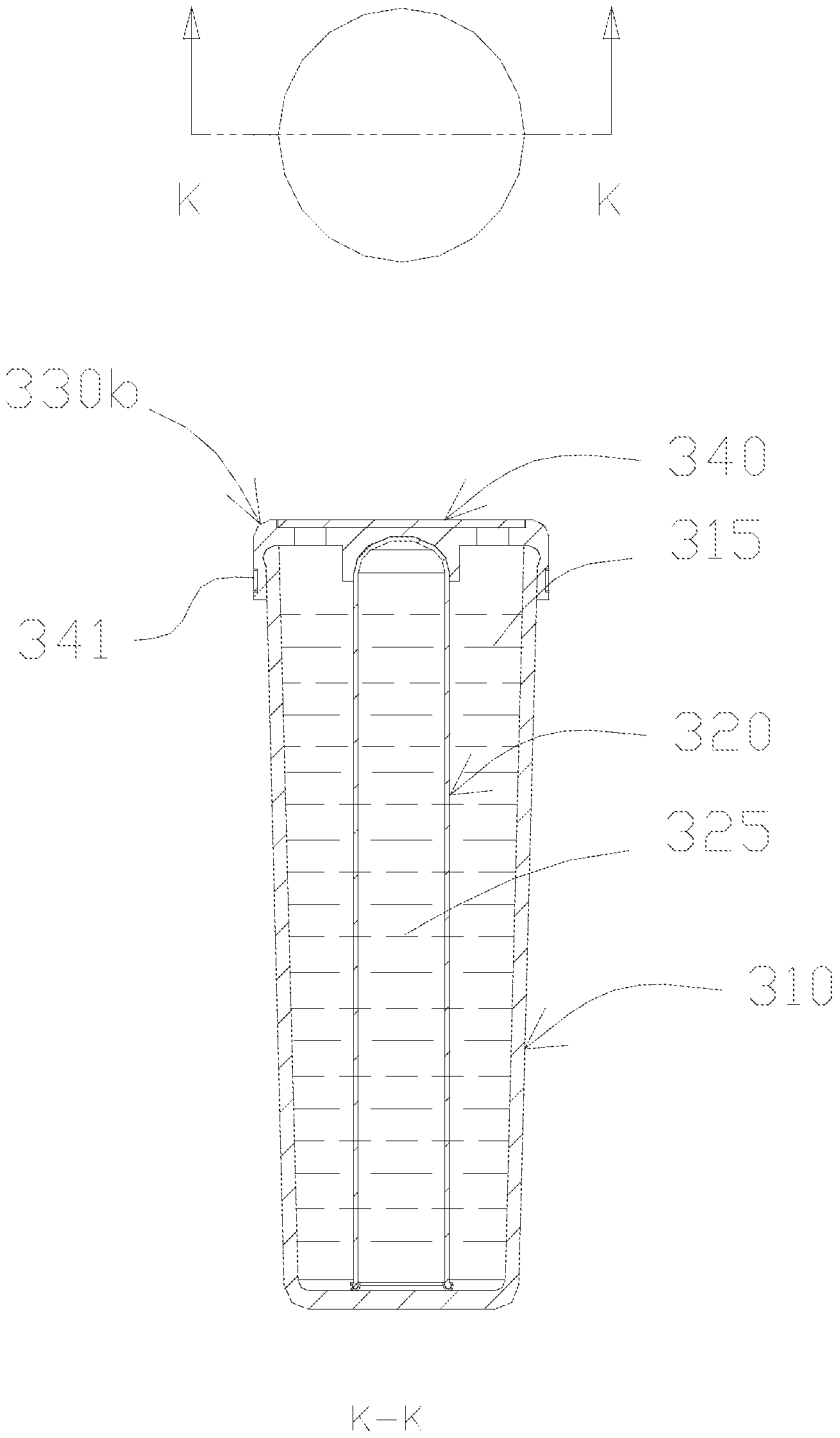
FIG. 12 is a cross-sectional view of the multi-compartment mixing container of FIG. 11.

In FIG. 3, the fill cap 330 is depicted as comprising half-threads that mate with corresponding half-threads surrounding the internal surface of the open mouth 312 of the outer container 310. In an alternative embodiment, as shown in FIGS. 11-12, the mating may be provided by a friction fit of the fill cap 330*b* with the upper lip of the outer container 310. A locking ring 341 may further be provided to further couple the assembled fill cap 330*b* and the outer container 310. Alternatively, corresponding full- or half-threads may be provided on the inside of the fill cap 330*b* and the outside of the outer container 310 to couple the fill cap 330*b* with the outer container 310.

Once the mixing container is filled and assembled (as further described in relation to FIGS. 9A-D), it is particularly desirable to ensure that the contents of the inner container 320 do not substantially leak or otherwise substantially mix with the outer container 310, or vice versa. To that end, a seal 319 may be provided.

In a preferred embodiment, the seal 319 is made of a resilient material, such as silicone, and is disposed between the open mouth 326 of the inner container 320 and the bottom 316 of the outer container 310 to ensure form a substantially leak-proof seal at the junction. An additional seal 329 may be provided between the fill cap 330 and the open mouth 312 of the outer container 310 to ensure a further leak-proof seal. The seals 319, 329 may be sprayed on or bonded on as solids or other means evident to someone skilled in the art.

The seals 319, 329 may be made of the same material or of different materials. Preferably, the material is an elastomeric material, such as a fluoroelastomer (Viton®), silicone, silicone rubber, natural rubber, butyl rubber, or a combination of the foregoing or even natural materials such as cork or wood in combination with an adhesive. Alternatively, the seals 319, 329 may be a thin layer of an elastomeric material that is applied to or sprayed on the interior surface of the bottom 316 of the outer container 310.

Figure 6A:
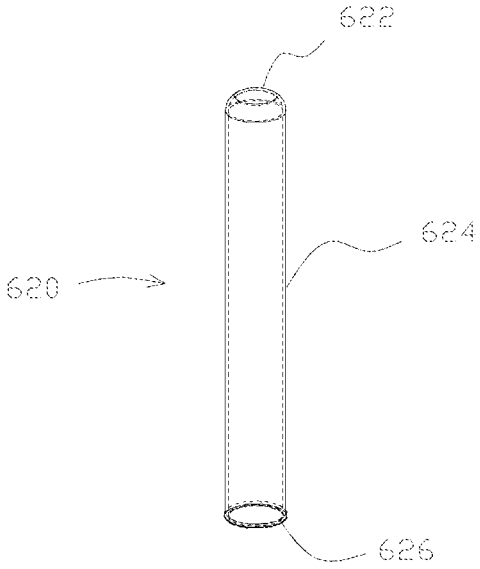
FIG. 6A is a perspective view of an inner vessel having a closed end and an open mouth.
Figure 6B:
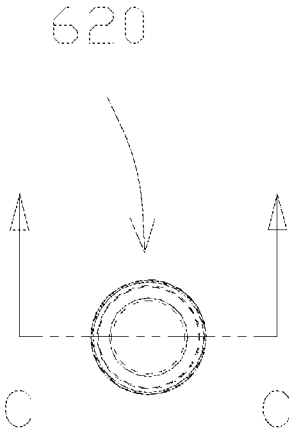
FIG. 6B is a top elevational view of the inner vessel of FIG. 6A.
Figure 6C:
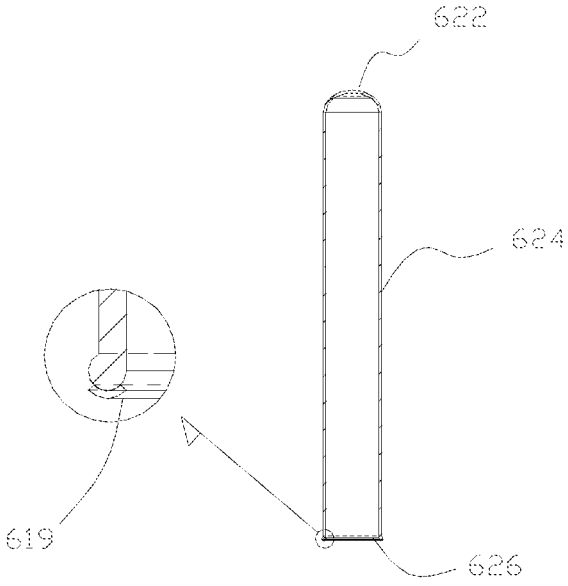
FIG. 6C is a cross-sectional view of the inner vessel taken along C-C of FIG. 6B and further showing a seal coupled to the periphery of the open mouth to allow for the formation of an interior seal between the open mouth of the inner vessel and the bottom of the outer vessel.

The seal 319 may be coupled to the inner container 320 such that removal of the inner container 320 also removes the seal 319, leaving behind an outer container 310 containing the mixture. This is particularly desired where the outer container 310 may be used as a drinking vessel or cup after removal of the closure cap 340, fill cap 330 and inner container 320. FIGS. 6A-C depict one embodiment of an inner container 620 comprising a closed end 622, an open end 626 and a peripheral sidewall there between 624 in which a seal 619 is depicted as being affixed to the outer periphery of the open end 626.

Figure 10:
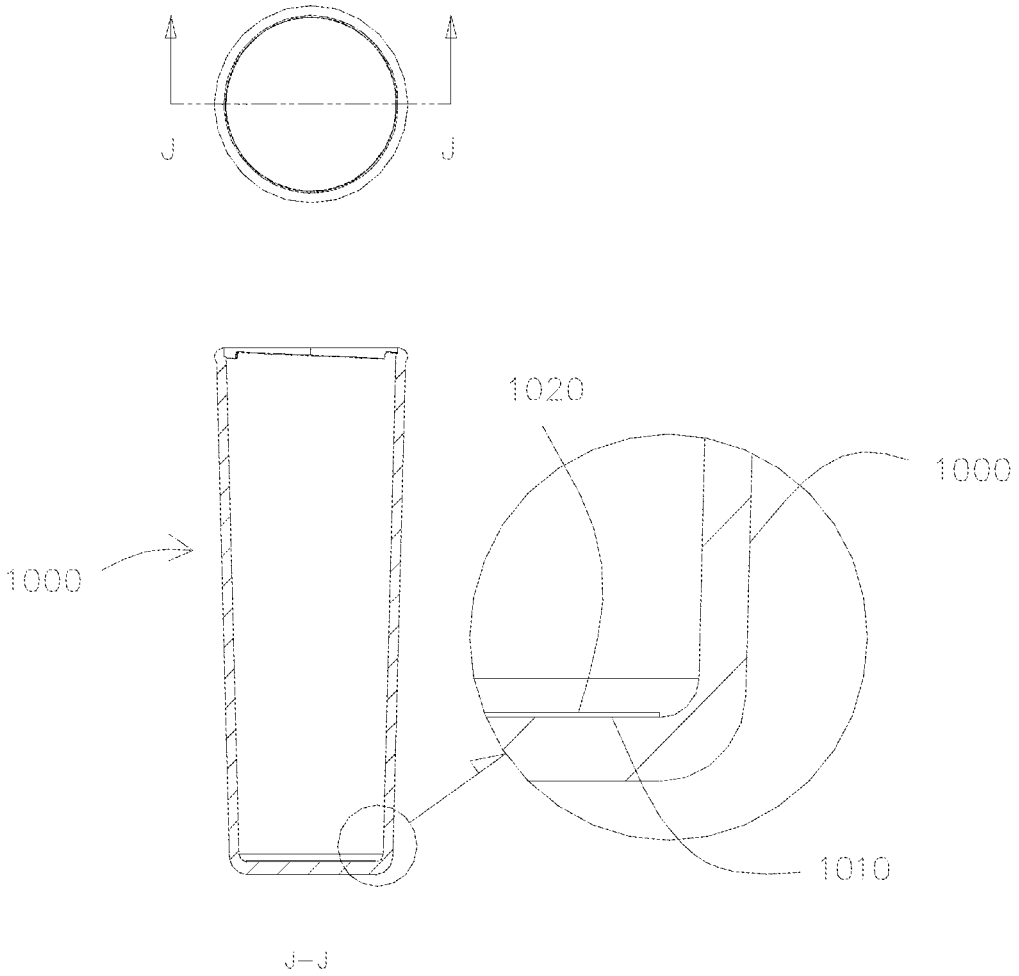
FIG. 10 depicts an outer container having a seal disposed along the interior bottom surface.

Alternatively, the seal may also be provided on the bottom surface of the outer glass. FIG. 10 depicts an outer container 1000 having a seal 1020 provided on the interior surface of the bottom 1010. The seal 1020 may line the entire interior surface of the bottom 1010 or it may line a portion of the interior surface of the bottom 1010 that will be in contact with one or more open mouths of an inner container (not depicted) to provide a seal. The seal may be a layer that is a few microns thick or thinner if the manufacturing tolerances with respect to the dimensions of the inner and outer containers is sufficiently narrow.

One difference between the mixing container depicted in FIGS. 1A-B and 2A-B, on the one hand, and the mixing container depicted in FIG. 3, on the other hand, is the number of inner containers provided and the position of the inner containers relative to the central axis A. As can be seen in FIGS. 1A-B and 2A-B, where multiple inner containers are provided, there will be at least one inner container that cannot be positioned along the central axis or alternatively, all inner containers may be positioned away from the central axis A. Alternatively, the location of the inner compartments may be dictated by an end use requirement or for aesthetics.

In preferred embodiments, the open mouth of the inner vessel(s) is resiliently biased against the bottom of the outer vessel, either directly or through an intermediate sealing element (e.g., 619 in FIG. 6, 1020 in FIG. 10). Again, in embodiments where the lid or closure cap and fill lid are removed from the outer vessel by rotation, there is the risk that the inner vessel may break or become dislodged from the closure cap due to the twisting motion during closing or opening. This risk is increased for the inner containers that are not disposed along the central axis of rotation A. One means of addressing this is by providing a closure cap or lid that does not require significant or any twisting action for closing or opening (e.g., partial- or half-threads or friction fit).

Figure 4A:
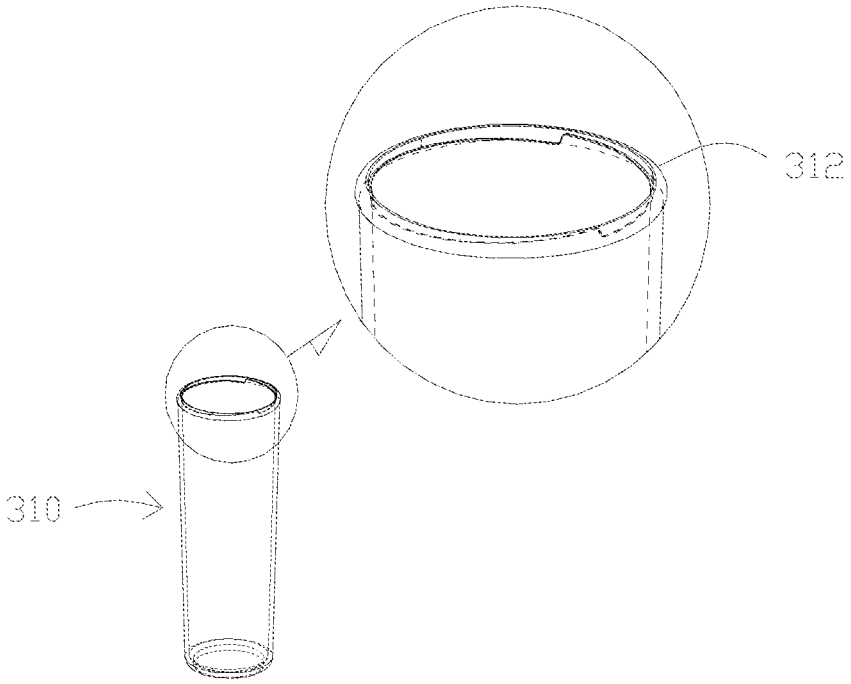
FIG. 4A is a perspective view of the outer vessel showing in detail the configuration of the lip along the periphery of the open mouth.
Figure 4B:
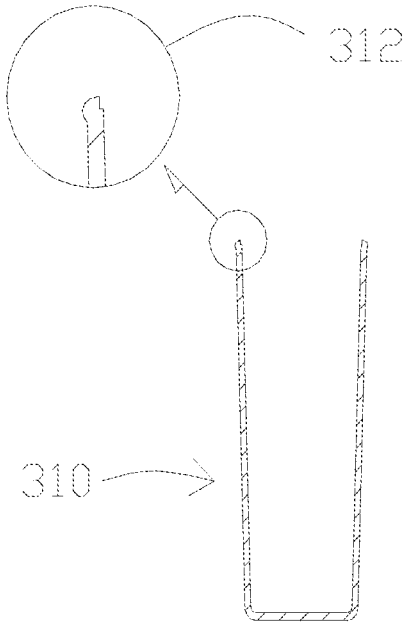
FIG. 4B is a cross sectional view of the outer vessel showing in detail the configuration of the lip along the periphery of the open mouth.

FIGS. 4A-B depict the configuration of the open mouth 312 of the outer vessel 310 in greater detail. The open mouth 312 is shown to comprise half-threads. One advantage of having half-threads, instead of full threads, is the reduction of twisting required to open or close the outer vessel. The half-threads 312 are depicted in FIG. 4B as forming a sloping surface that will force the cover or lid open when twisted in one direction. The half threads are configured in a manner to urge the affixed cover in essentially a vertical motion away from the outer container.

Figure 5A:
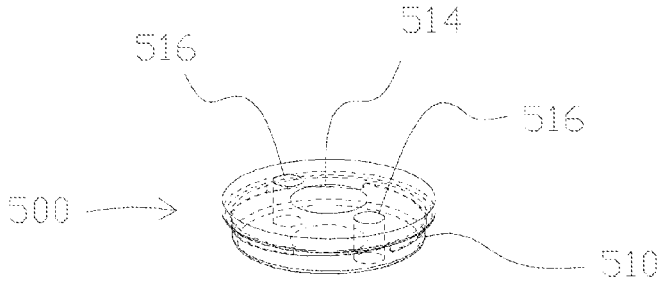
FIG. 5A is a perspective view of the lid configured to be removably coupled to the open mouth of the outer vessel.
Figure 5B:
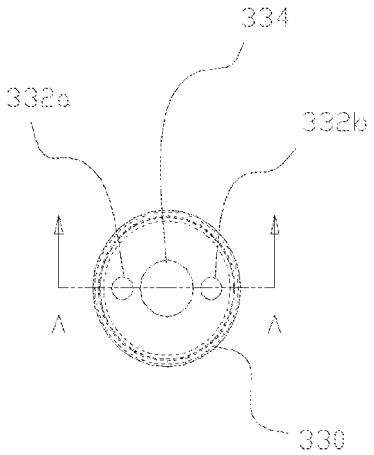
FIG. 5B is a top elevational view of the lid of FIG. 5A.
Figure 5C:
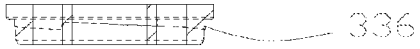
FIG. 5C is a cross-sectional view of the lid taken along A-A of FIG. 5B.

FIGS. 5A-C depict a lid 330 having corresponding half-threads 336 configured to mate with the half-threads disposed around the open mouth 312 of the outer container 310 of FIGS. 4A-B. The lid 330 comprises two sets of fill holes 332, 334 corresponding to the filling of the inner container 320 and an outer container 310, respectively, of the type described in FIG. 3. The inner fill hole 334 is further configured to provide a coupling surface for attaching to the side wall 324 of the inner container 320 adjacent the open end 322.

Figure 13A:
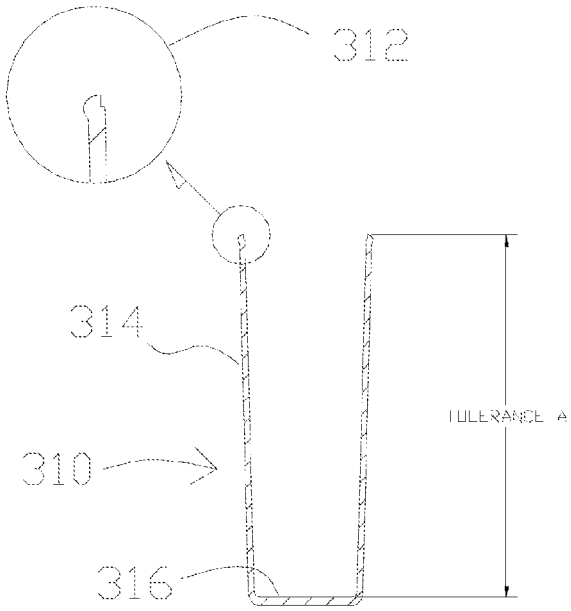
FIGS. 13A-B depict the relative tolerances for the dimensions of the outer container and the lid and inner container assembly.
Figure 13B:
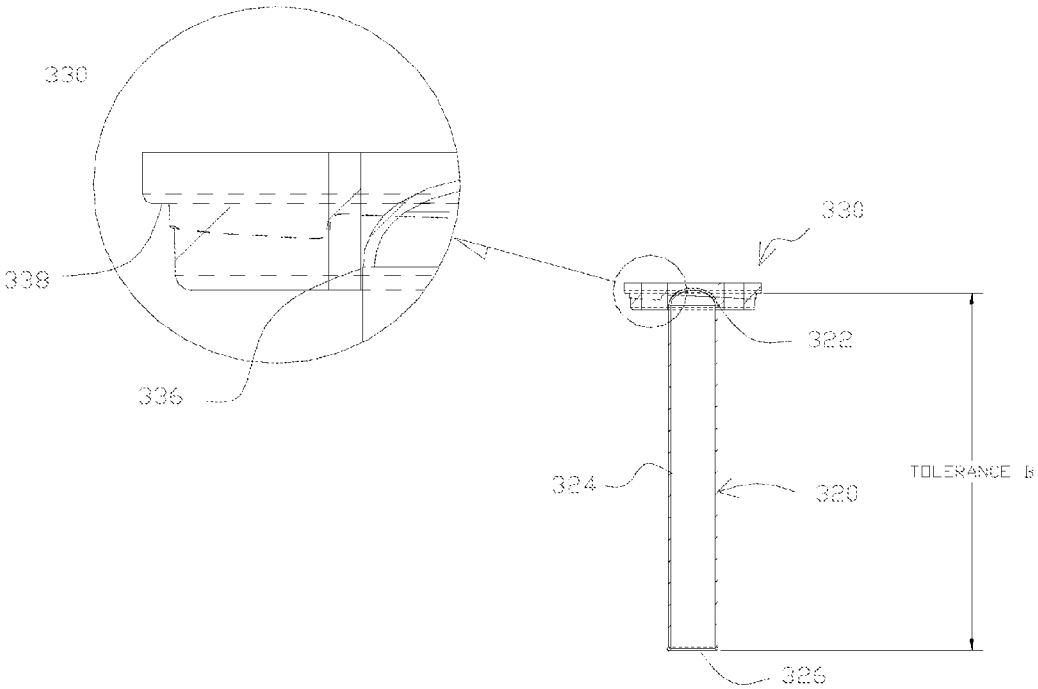

FIGS. 13A-B depict the relative tolerances between the dimensions of the outer container 310 and the dimensions of the inner container 320 that is coupled to the lid 330.

In FIG. 13A, the lip 312 and the inner surface of the outer container 310 is preferably formed by a single mandrel such that a substantially constant dimension (Tolerance A), as measured from the top of the open mouth 312 to the interior bottom surface 316 of the outer container 310, is obtained. The use of an internal mandrel during the manufacturing process thus allows for a narrow range for Tolerance A, while allowing the mandrel to be removed with relative ease.

In order for a substantially leak-proof interior seal to be formed between the inner containers 320 and the outer container 310, there must be physical contact between the open mouth 326 of the inner container 320 and the bottom 316 of the outer container 310 when the container is assembled. Where a seal is provided between the open mouth 326 of the inner container 320 and the bottom 316 of the outer container 310, the contact must be sufficient to provide a barrier between the interior cavities defined by the inner container 320 and the outer container 310.

FIG. 13B shows the vertical distance between the abutment portion 338 (i.e., the portion that rests on top of the open mouth 312) and the open mouth 326 of the inner container 320 (Tolerance B). The abutment portion 338 may be provided by the lid 330 itself or a seal disposed around the lid (see, e.g., 329 in FIG. 3). The distance represented by Tolerance B may be equal to or less than the distance represented by Tolerance A. Where Tolerance B is less than Tolerance A, the thickness of the seal placed between the open mouth 326 of the inner container 320 and the bottom surface 316 of the outer container may be determined based on this difference. For example, the thickness of the seal disposed between the open mouth 326 and the bottom surface 316 may be equal to, or slightly greater than, Tolerance A minus Tolerance B. In all cases, the combination of the two seals, one at 326 and one at 338 provide for positive sealing.

The relative differences between Tolerance A and B, and thus the thickness of the seal required, may be varied by providing a coupling surface 336. The coupling surface 336 may be any surface that allows the lid 330 to couple to the inner container 320 at more than one location along its vertical length. As shown in FIG. 13B, the coupling may simply be a surface having a vertical length that may be coupled to the inner container 320 at various points long its vertical length. Thus, coupling surface 336 may be used to couple the inner container 320 at different locations about its peripheral side wall 324 such that the distance for Tolerance B may be adjusted upwards or downwards. This coupling is preferably meant to be permanent prior to mating with the body 310. Seal thicknesses would preferably cover tolerance build-ups as well as changes due to thermal expansions.

The lengths of the respective inner and outer containers 320, 310 are preferably provided within a relatively precise range in order to ensure the formation of a seal when the inner container 320 is coupled to the lid 330 and the inner container/lid assembly is coupled to the outer container 310. The seal is generally created as the open mouth 326 of the inner container 320 is resiliently biased against the bottom surface 316 of the outer container 310. As previously disclosed, this may be by direct contact between the open mouth 326 and the bottom surface 316 or via an intermediate seal 319. The narrower the manufacturing tolerances achieved with respect to the relative lengths of the inner and outer containers 320, 310, the thinner the seal.

Figure 7A:
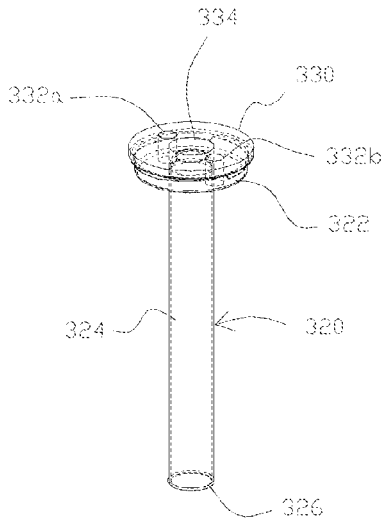
FIG. 7A is a perspective view of an inner vessel coupled to a lid.
Figure 7B:
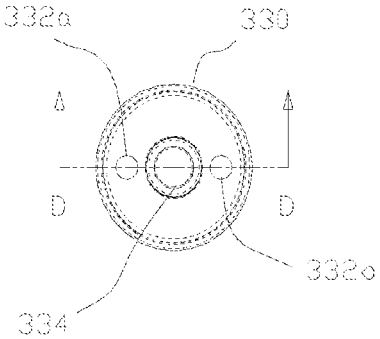
FIG. 7B is a top elevational view showing the outer surface of the lid of FIG. 7A.
Figure 7C:
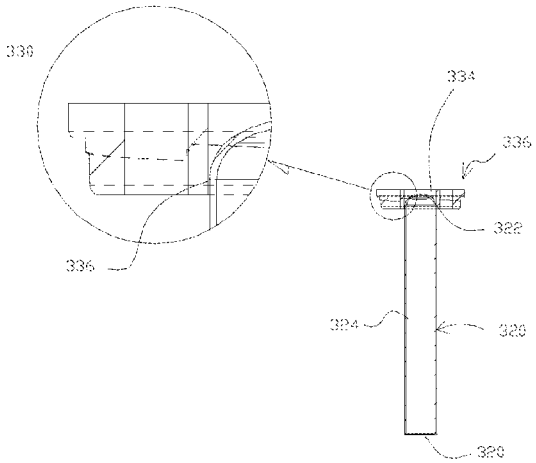
FIG. 7C is a cross-sectional view of the inner vessel coupled to the inner surface of the lid of FIG. 7A.

FIGS. 7A-C depict the coupling of an inner container 320 and the lid 330. While FIGS. 7A-C show the inner container 320 as having a closed end 322, it is understood that the coupling may be accomplished in the same manner depicted with respect to inner containers having an open top end (see FIGS. 2A-C).

Again, the inner container 320 has an open bottom end 326 and a peripheral side wall 324 between the closed top end 322 and open bottom end 326. The lid 330 is provided with a pair of holes 332 which permit the filing of the outer container 310 after the lid 330 is coupled thereon.

The lid 330 is further provided with a coupling area 336 to which the inner container 320 is affixed. As shown in more detail in FIG. 7C, the coupling area 336 may comprise a surface which may be coupled to the peripheral side wall 324 of the inner container 320. In a preferred embodiment, the coupling surface 326 is a substantially vertical surface that corresponds with the configuration of the peripheral side wall 324 adjacent the closed end 322 of the inner container 320. Elastomeric materials may optionally be applied to the vertical surface 336 to provide a friction fit helping to hold the lid 330 and the outer container 310 somewhat together prior to finally assembly.

A vertical distance is provided along the coupling surface 336 so that the inner container 320 may be adjustably coupled to the lid 330. In order to effectuate a seal between the open mouth 326 of the inner container 320 and the bottom 316 of an outer container 310, the length of the inner container 320 must be such that it contacts the bottom of the outer container or at least the seal to effectuate a water-tight seal.

Once the desired length of the inner container 320 protruding from the lid 330 is obtained, the inner container 320 may be affixed to the lid 330 at the coupling surface 336. This may be accomplished by adhesive. The adhesive is preferably waterproof and resistant to degradation by organic solvents, such as alcohol. Alternatively, if the material of the containers is plastic or glass, heat may be used to fuse the lid 330 and inner container 320 together. Alternatively, the inner compartments and lid may be formed at the same time.

Now turning to the methods of filling a multi-compartment mixing container comprising two or more separate components therein, FIGS. 8A-E describe the method in relation to the containers of FIGS. 1A-B and FIGS. 9A-D describe the method in relation to the containers of FIGS. 2A-C.

FIG. 8A-E illustrate a method of filling a mixing container comprising two or more components, in which the inner container 820 has a closed upper end 822, as described in relation to FIGS. 1A-B. The inner container 820 is coupled to the lid 830 along the vertical surface of its peripheral side wall 824 adjacent the closed end 822 within a coupling area 834 of the lid 830, with adjustments as to desired length of the inner container 820 protruding from the lid 830 being made in order to effectuate a seal when assembled with the outer container 810.

Figure 8A:
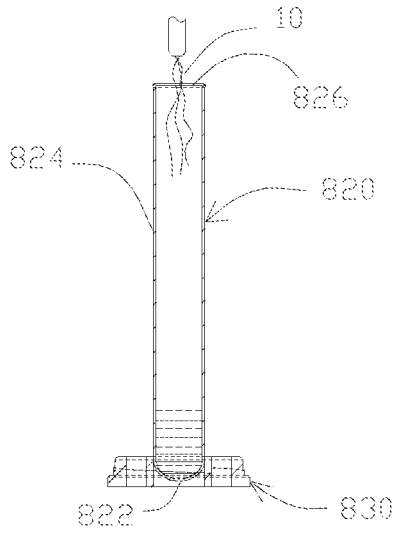
FIGS. 8A-E depict the sequence of filling a mixing container comprising an inner vessel having a closed end.
Figure 8B:
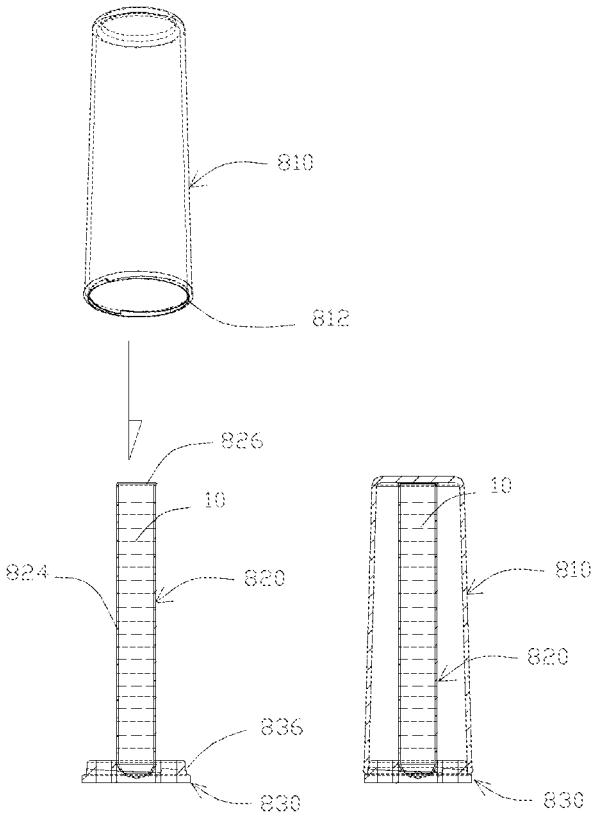

In FIG. 8A the lid 830 and inner container 820 assembly is inverted and filled through the open end with a first component 10. Once the filing operation for the inner container 820 is complete, the outer container 810 is coupled to the lid 830, as shown in FIG. 8B, and a seal is formed between the open mouth 826 of the inner container 820 and the interior bottom surface of the outer container 810 so as to contain the first component 10 within the inner container 820.

Figure 8C:
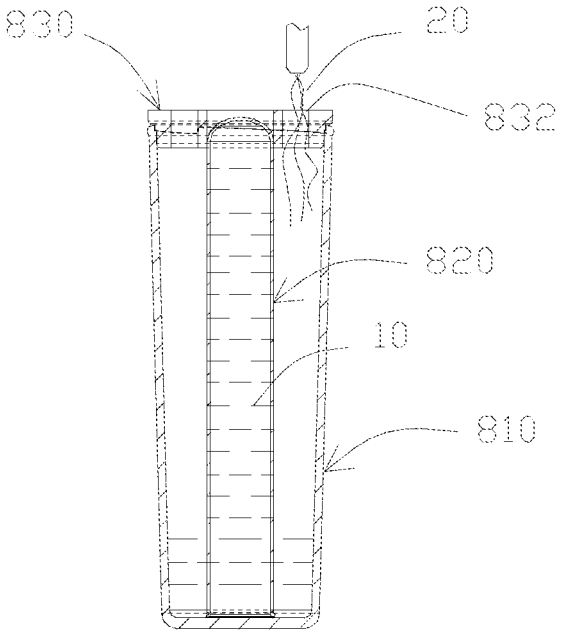
Figure 8D:
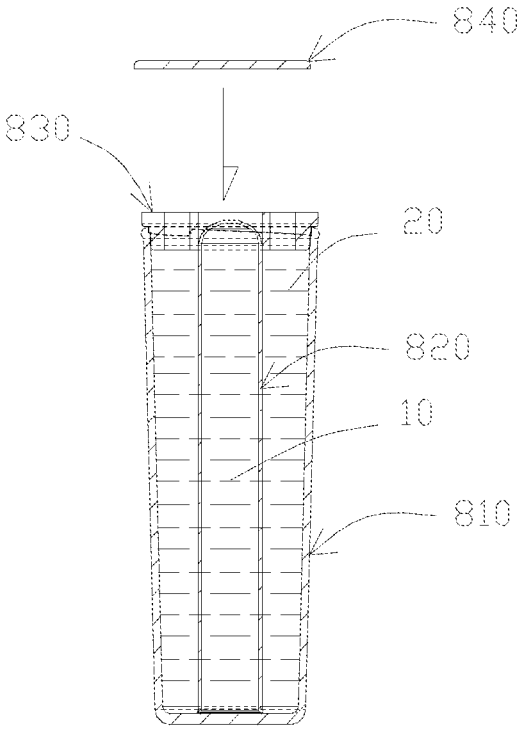

The entire assembly is then inverted and, in FIG. 8C, the outer container 810 is filled with a second component 20 through one of the fill holes disposed on the lid 830. Once the filling operation for the outer container 810 is complete, a cover 840 is affixed onto the lid 830 to seal the fill holes, as shown in FIG. 8D. The air in the headspace of the outer container 810 may be optionally be evacuated prior to affixing the cover 810 on to the lid 830 so as to create at least a partial vacuum, which also assists in keeping the lid 830 and cover 840 affixed to the outer container 810.

Figure 8E:
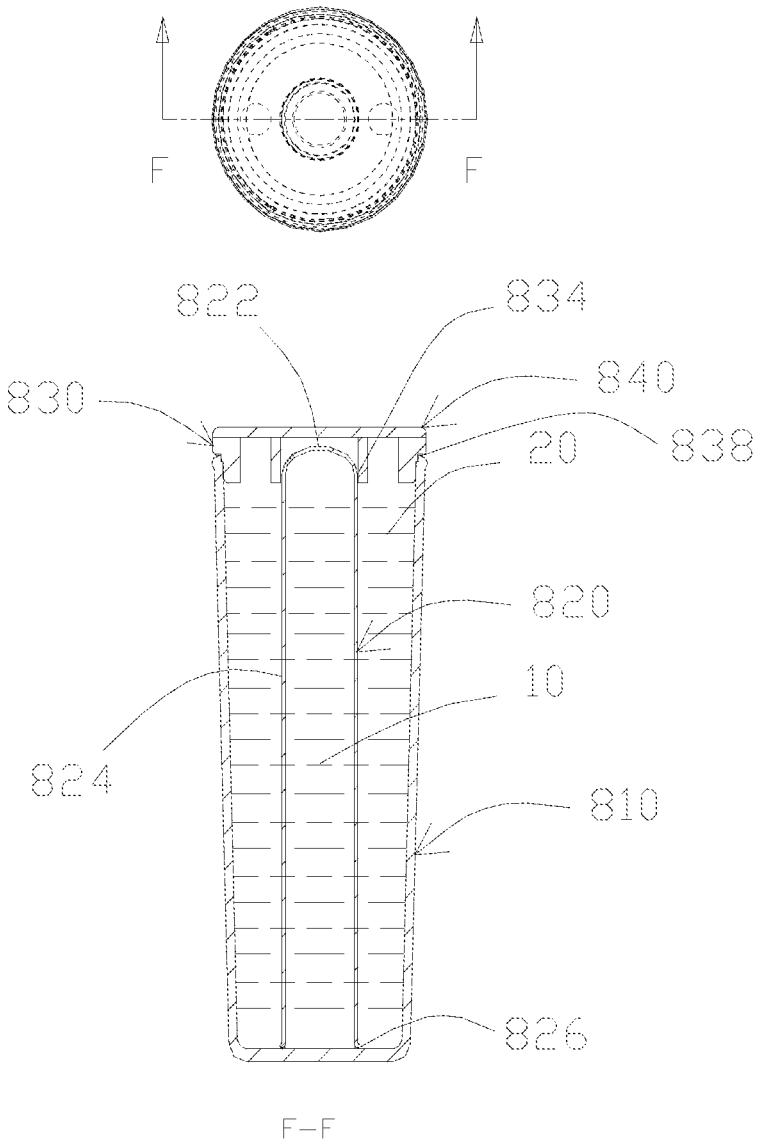

As further shown in FIG. 8E, the mixing container now comprises two different components 10, 20, separately stored within the outer container 810. The coupling surface 834 on the underside of the lid 830 is also depicted in further detail. As described above, this coupling surface 834 permits the inner container 820 to be coupled to the lid 830 to achieve the tolerance required for the coupled inner container 820 and lid 830 to create an interior seal between the open mouth 826 of the inner container 820 and the interior bottom surface 816 of the outer container. In the embodiment depicted in FIG. 8E, the inner container 820 may be slidably adjusted toward or away from the direction of the lid 830 to provide the length required for the open mouth 826 of the inner container 820 to achieve that seal. As shown in FIG. 8E, that length is generally between the abutting surface 838 of the lid 830 and the open mouth 826 of the inner container 820. The abutting surface 838 may alternatively be provided by a seal disposed on the lid 830.

Figure 9A:
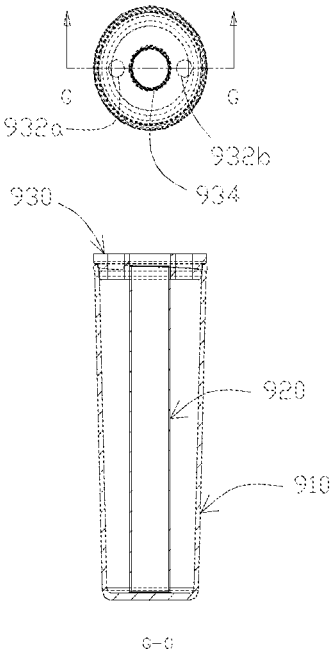
FIGS. 9A-D depict the sequence of filling a mixing container comprising an inner vessel having two open ends.
Figure 9B:
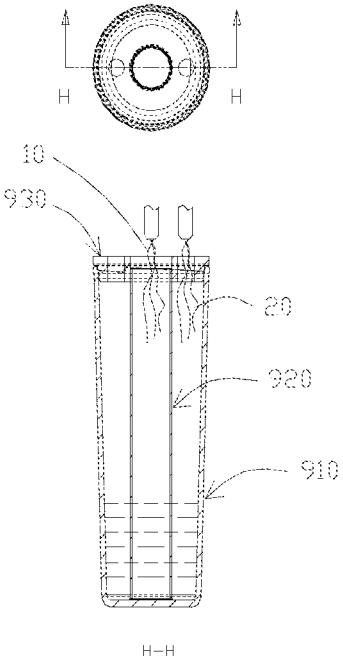
Figure 9C:
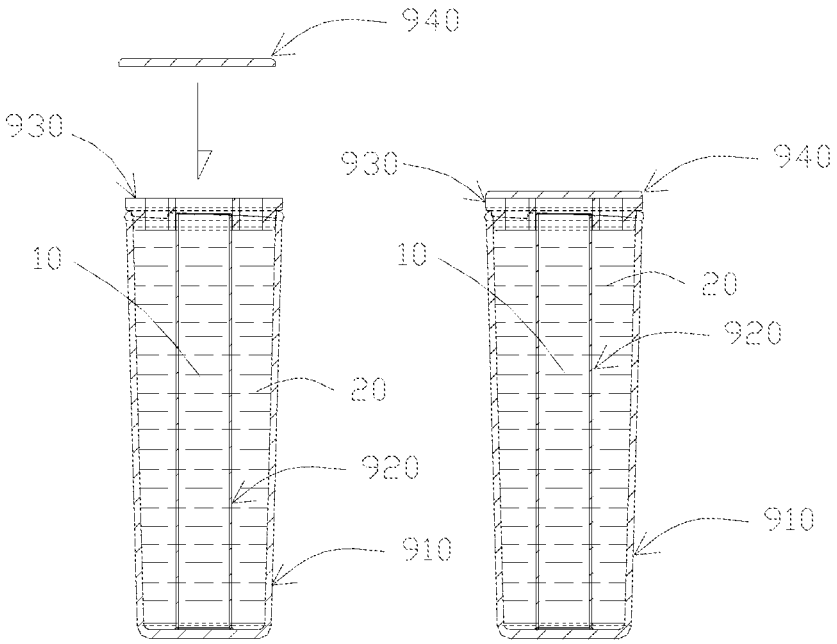
Figure 9D:
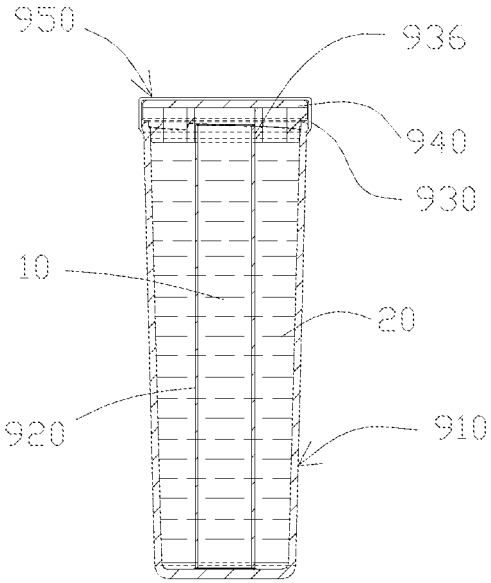

FIGS. 9A-D illustrate another method of manufacturing a mixing container comprising two or more components, in which the inner container 920 has an open upper end 922, as described in relation to FIGS. 2A-C. Unlike the method described in FIGS. 8A-E, the method described in relation to FIGS. 9A-D allow for the complete assembly of the outer and inner containers 910, 920 and the lid 930 prior to the filling operations (FIG. 9A). In addition, as shown in FIG. 9B, the outer and inner containers 910, 920 may be filled simultaneously with the respective components 10, 20, through the respective fill holes, 932*a*, 934. Once the filling operations are complete, the cover 940 may be applied to the lid 930, as shown in FIG. 9C, to seal the fill holes to provide a mixing container that comprises two different components within the outer container 910. As shown in FIG. 9D, a tamper evident seal 950 may optionally be applied.

It is to be understood that the detailed description and specific examples, while indicating preferred embodiments of the present invention, are given by way of illustration and not limitation. Many changes and modifications within the scope of the present invention may be made without departing from the spirit thereof, and the invention includes all such modifications.

What is claimed is:

1. A mixing container comprising:

an outer vessel having a bottom, an open mouth and a peripheral sidewall between the open mouth and the bottom;

a plurality of inner vessels each having an open end, an open mouth and a peripheral sidewall between the open end and the open mouth, the plurality of inner vessels being arranged in a spaced relation from one another; and a lid configured to be removably coupled to the open mouth of the outer vessel, the lid and the open mouth of the outer vessel each comprising mating features for removably coupling the lid and the open mouth, the lid comprising an outer surface and an inner surface coupled to the open end of each of the plurality of inner vessels;

wherein a seal is formed between the open mouth of each one of the plurality of inner vessels and the bottom of the outer vessel when the lid is coupled to the open mouth of the outer vessel.

2. The mixing container of claim 1, further comprising one or more fill holes disposed on the lid, the one or more fill holes being in communication with at least one of the outer vessel and/or the inner vessel.

3. The mixing container of claim 2, further comprising a cover secured to the lid to cover the one or more fill holes.

4. The mixing container of claim 1, wherein the seal is formed by providing a raised surface on the interior of the bottom of the outer vessel having a periphery and the open mouth on each one of the plurality of inner vessels being and fitting about the periphery.

5. The mixing container of claim 1, wherein the seal is formed by a resilient seal member disposed between the open mouth of each one of the plurality of inner vessels and the bottom of the outer vessel.

* * * * *